US006505902B1

(12) United States Patent
Teumer et al.

(10) Patent No.: US 6,505,902 B1
(45) Date of Patent: Jan. 14, 2003

(54) MAIL PIECE PRODUCING MACHINE HAVING A WIDE SWATH ENVELOPE PRINTING MODULE

(75) Inventors: Roger G. Teumer, Fairport, NY (US); W. Keith Gilliland, Webster, NY (US); Stephen F. Pond, Oakton, VA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/660,588

(22) Filed: Sep. 13, 2000

(51) Int. Cl.[7] ..... B41J 25/308
(52) U.S. Cl. ..... 347/8; 347/2
(58) Field of Search ..... 347/8, 2, 42, 37; 400/103, 355, 605, 124.08, 124.09; 101/47

(56) References Cited

U.S. PATENT DOCUMENTS

| | | | | | |
|---|---|---|---|---|---|
| 4,208,666 | A | * | 6/1980 | Paranjpe | 346/75 |
| 4,797,830 | A | | 1/1989 | Baggarly et al. | 364/464.03 |
| 5,067,305 | A | | 11/1991 | Baker et al. | 53/411 |
| 5,283,752 | A | | 2/1994 | Gombault et al. | 364/478 |
| 5,326,181 | A | * | 7/1994 | Eisner et al. | 400/104 |
| 5,428,375 | A | * | 6/1995 | Simon et al. | 347/12 |
| 5,730,049 | A | * | 3/1998 | Broschart | 101/91 |
| 5,774,139 | A | * | 6/1998 | Salzer et al. | 347/32 |
| 5,912,682 | A | * | 6/1999 | Parkos | 347/40 |
| 6,312,121 | B1 | * | 11/2001 | Smith et al. | 347/96 |

* cited by examiner

*Primary Examiner*—John Barlow
*Assistant Examiner*—Ly T Tran
(74) *Attorney, Agent, or Firm*—Tallam I. Nguti

(57) ABSTRACT

An apparatus for producing pieces of mail includes mail handling assemblies; and a printing module connected to the mail handling assemblies and having a first printing position, a second printing position, a moveable carriage for moving to and from the first printing position and the second printing position, and a first printhead cartridge mounted at a first location on the moveable carriage and including a first printhead having a first path of movement with the moveable carriage at and through the first printing position and the second printing position. The printing module also includes a second printhead cartridge mounted at a second location on the moveable carriage for increasing a width of a swath printed by the first printhead cartridge and the second printhead cartridge. The second printhead cartridge includes a second printhead having a second path of movement with the moveable carriage at and through the first printing position and the second printing position. The apparatus for producing mail pieces further includes a first registration member located at the first printing position for maintaining a first gap between pieces of mail to be printed on by the first printhead and the second printhead, and a second registration member located at the second printing position for maintaining a second gap between itself and the first printhead and the second printhead.

9 Claims, 3 Drawing Sheets

MAIL PIECE PRODUCING MACHINE HAVING A WIDE SWATH ENVELOPE PRINTING MODULE

BACKGROUND OF THE INVENTION

The present invention relates to a system for producing a mail piece, and more particularly, it relates to a mail piece producing machine having a wide swath envelope printing module.

Many systems for directly producing mail pieces from the printed output of a data processing system have been proposed in the past. Systems that include a plurality of apparatus for producing a mail piece are well known, wherein the apparatus each include a printer for printing a document and a mail finishing unit for receiving the document from the first printer and combining the document with an envelope to form a mail piece. The mail finishing unit includes a mechanism for franking the mail piece.

The data processing system controls a printer to print documents which, after printing, pass, under the control of the data processing system, through a succession of stations such as a burster, an insert feed station, an address printer, a postage meter and the like.

Similarly, U.S. Pat. No. 5,283,752; to Gombault et al.; issued Feb. 1st. 1994 discloses a mail preparation system wherein a data processing system controls a linear mail preparation apparatus. The data processing system controls a printer to print documents which, after printing, pass, under the control of the data processing system, through a succession of stations such as a burster, an insert feed station, an address printer, a postage meter and the like.

A system where an envelope form is printed in sequence with documents and later accumulated with the documents, then wrapped around the documents and sealed to form the mail piece is described in U.S. Pat. No.: 5,067,305 issued Nov. 26, 1991 to Baker et al.

U.S. Pat. No. 4,797,830 to Baggarly et al, describes an inserter system which has a capability to compute postage for a mail piece based upon predetermined weights for inserts included in the mail piece.

While such systems are perhaps suitable for their intended purpose heretofore no system has been available to users who wish to produce a number of mailings of moderate size and who wish to produce high quality mail pieces with wide swaths for easy reading and for easily accommodating addresses such as some foreign addresses having four or more lines of print.

SUMMARY OF THE INVENTION

In accordance with the present invention, there is provided an apparatus for producing pieces of mail includes mail handling assemblies; and a printing module connected to the mail handling assemblies and having a first printing position, a second printing position, a moveable carriage for moving to and from the first printing position and the second printing position, and a first printhead cartridge mounted at a first location on the moveable carriage and including a first printhead having a first path of movement with the moveable carriage at and through the first printing position and the second printing position. The printing module also includes a second printhead cartridge mounted at a second location on the moveable carriage for increasing a width of a swath printed by the first printhead cartridge and the second printhead cartridge. The second printhead cartridge includes a second printhead having a second path of movement with the moveable carriage at and through the first printing position and the second printing position. The apparatus for producing mail pieces further includes a first registration member located at the first printing position for maintaining a first gap between pieces of mail to be printed on by the first printhead and the second printhead, and a second registration member located at the second printing position for maintaining a second gap between itself and the first printhead and the second printhead.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
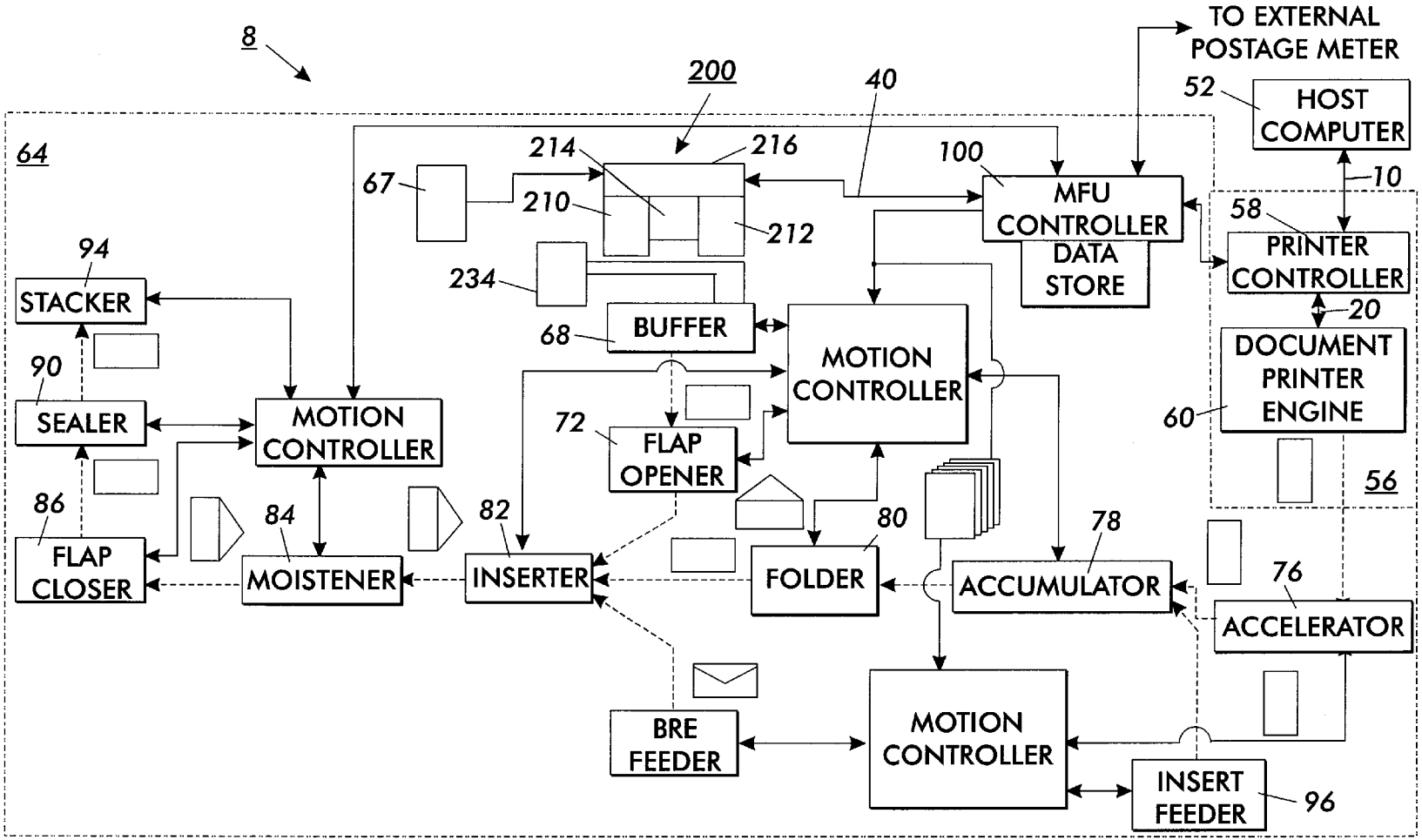
FIG. 1 is a schematic block diagram of a mail piece producing machine including the wide swath envelope printing module of the present invention.

Referring now to FIG. 1, there is illustrated a mail piece preparation and producing machine 8 for production and franking corresponding mail pieces. As shown, the machine 8 is connected to a mail center controller or host computer 52 for receiving job data 10 including mail piece attribute data, in the form of electronic digital signals. The job data 10 can, and is preferably modified to include postage values for each mail piece. Machine 8 includes a document printer 56, which is preferably a laser printer and includes a printer controller 58. The machine 8 also includes a conventional document printer engine 60, a wide swath envelope printing module 200 in accordance with the present invention(as will be described below), and a mail finishing unit 64. The mail finishing unit 64 receives the printed documents from printer engine 60 and inserts them into envelopes printed by the printing module 200 so as to form mail pieces produced according the job data and in accordance with the present invention.

Printer controller 58 receives from mail center controller or host computer 52, the job data 10 which comprises mail piece attribute data and mail finishing data, and then parses such data. Printer controller 58 then sends the mail piece attribute data from either job header (not shown) or mail piece header (not shown) to a mail finishing controller 100, and document data 20 to document printer engine 60. Controller 100 stores mail piece attribute data 40 from job header (not shown) for default control of the production of each mail piece, and downloads common elements of the addresses to be printed on the envelopes to the wide swath envelope printing module 200 of the present invention.

Preferably the wide swath envelope printing module 200 includes an integral controller 216 which will render the text characters received from machine controller 100 into appropriate control signals for printing an image of the address in accordance with the address data, the font, the layout and more. Envelope printing module 200 also stores the fixed portion of postal indicia to be printed on the envelope when the mail piece is to be franked in data store 67.

In one embodiment of the subject invention, where machine 8 has a capability to independently determine postage values for mail pieces, when a mail piece is to be franked controller 100 accesses per item weight, an external postage meter (as shown) and a relevant data base to determine the weight of the mail piece and the appropriate postage value for the mail piece. Machine 8 then returns postage costs (and, optionally, material usage) to mail center controller or host computer 52 for allocation of costs to user accounts. If the postage value has not been determined a priori, mail center controller or host computer 52 calculates postage and material costs in accordance with the mail piece data, and appends a postage value to mail piece header (not shown).

Once the postage value is determined, controller 100 then requests postal indicia corresponding to that value, for example from a class 2 meter (not shown) which, assuming the request is granted, returns the variable portion of the indicia to controller 100. The meter, of course, accounts for the postage expended in a conventional manner. Controller 100 then downloads this variable data to the wide swath envelope printing module 200 together with address and other information to be printed on the envelope. Wide swath envelope printing module 200 then renders the full image to be printed on the envelope, combining the fixed portion of the indicia stored in data store 67 with the variable portion received from controller 100 to frank the mail piece.

Alternatively the postage amount may be down loaded to wide swath envelope printing module 200 for printing as a scannable representation such as a bar code so that the mail piece can later be scanned and franked off line.

Figure 2:
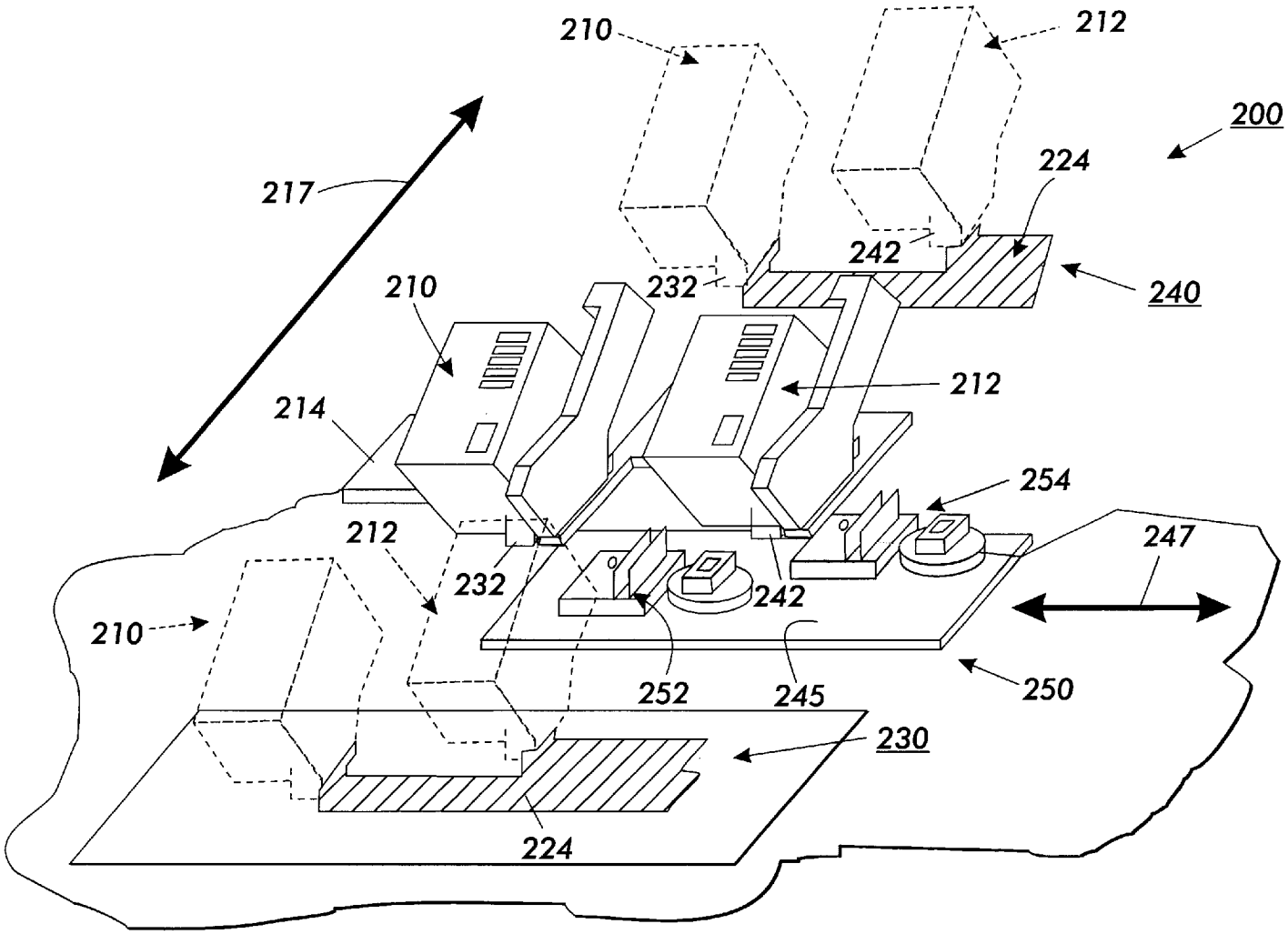
FIG. 2 is a schematic of the wide swath printing module of the present invention.
Figure 3:
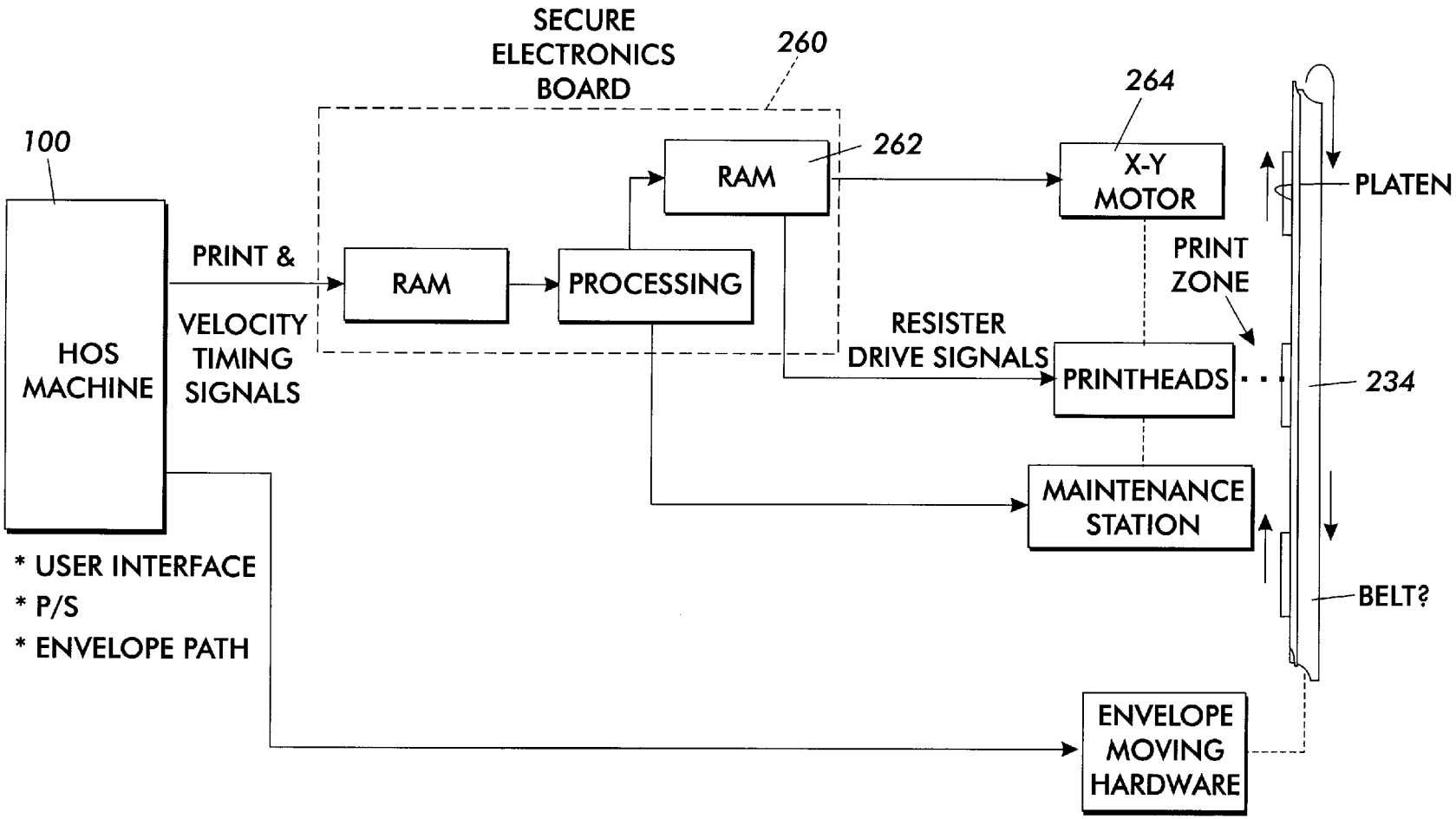
FIG. 3 is a schematic block diagram of the electronic controls for the wide swath envelope printing module of the present invention.

Referring now to FIGS. 1–3, the wide swath envelope printing module 200 of the present invention comprises a plurality of printing positions including a first or front printing position 230 and a second or rear printing position 240; a moveable printhead carriage 214 for moving as shown by arrow 217, to and from the first or front printing position and the second or rear printing position. The wide swath envelope printing module 200 of the present invention also comprises a first printhead cartridge 210 mounted at a first location to the moveable printhead carriage 214 and including a first printhead 232 (preferably a thermal ink jet printhead) having a first path of movement with the moveable printhead carriage at and through the first or front printing position and the second or rear printing position. It also comprises a second printhead cartridge 212 mounted at a second location to the moveable printhead carriage 214 for increasing a width of a swath 224 printed by the first printhead cartridge and the second printhead cartridge. In accordance with the present invention, the wide swath 224 is printed on an envelope in the front printing position 230, and on peel off labels on a continues tape, in the rear printing position 240. The second printhead cartridge 212 includes a second printhead 242 (preferably a thermal ink jet printhead) having a second path of movement with the moveable printhead carriage at and through the second or rear printing position.

The first printhead cartridge 210 and the second printhead cartridge 212 are mounted to the printhead carriage 214 such that the first printhead 232 of the first printhead cartridge and the second printhead 242 of the second printhead cartridge, have offset and parallel jet axes. Preferably, the offset and parallel jet axes overlap one another by a number of jets, for example about 4 jets, along a direction of the parallel jet axes.

The wide swath envelope printing module 200 of the present invention also comprises a first registration member (not shown) located at the first or front printing position for maintaining a first gap between the printheads 232, 242 and mail envelopes to be printed on by the first printhead and the second printhead, as well as a second registration member (not shown) located at the second or rear printing position for maintaining a second gap between itself and the printheads 232, 242.

As shown, the wide swath envelope printing module 200 of the present invention further has a maintenance position 250 that is spaced from the first or front printing position 230 and the second or rear printing position 240. Two maintenance units 252, 254 are provided for cleaning the first and the second printheads 232, 242 at the maintenance position. As illustrated, the first maintenance unit 252 and the second maintenance unit 254, are mounted to a maintenance carriage 245 and are offset relative to one another, for properly aligning with the first and the second printheads 232, 242 during cleaning operations. The maintenance carriage 245 is moveable as shown by arrow 247, into and out of the maintenance position 250.

The moveable printhead carriage 214 is stationary during a printing operation, and mail envelopes to be printed on are moved past the first printhead cartridge and the second printhead cartridge thereof. As shown, the moveable printhead carriage 214 is also moveable to and from the maintenance position 250.

More specifically, the wide swath envelope printing module 200 of the present invention comprises the pair of replaceable ink jet printhead cartridges 210, 212 respectively including the first and the second printheads 232, 242 having parallel jet axes. The replaceable ink jet printhead cartridges 210, 212 are mounted on the moveable printhead carriage 214 , and such that the first and the second printheads 232, 242 thereof are offset relative to each other along the jet axes for providing the printed swath (on envelopes being printed), that relatively is wider than a swath that could have been printed just by comparable size printhead.

In operation, the moveable common, printhead carriage 214 moves in a reciprocating manner among the first or front printing position 230, the second or rear printing position 240 thereof for printing on the tape, and the maintenance position 250 thereof that include the dual maintenance units 252, 254 for maintaining the first and second printheads 232, 242. The front printing position 230 includes the registration member (not shown) having a registration surface for maintaining the fixed printing gap between envelopes being printed on and the printhead cartridges 210, 212, as the envelopes are transported past the printhead cartridges. The rear printing position 240 contains a tape drive (not shown) that also serves as the second registration member (not shown) for maintaining the fixed printing gap between tape being printed on and the printheads 232, 242. When the moveable common printhead carriage 214 is in the maintenance position 250, the dual maintenance units 252, 254 are moved under the printheads 232, 242 of the cartridges for performing maintenance and capping functions.

As illustrated in FIG. 3, controls including secure electronics 260 are provided, and are mounted on the printhead carriage 214. These controls function to decode encrypted indicia sent from the mail machine controller 100 for printing by the printheads 232, 242 on envelopes or tape.

As pointed out above, the two replaceable ink jet printhead cartridges 210, 212 are mounted such that the printheads 232, 242 are offset relative to each other. An offset or overlap of about 4 jets or nozzles along the jet axes has been found to enable printing of the relatively wide swath that is approximately twice the width of a similar swath printed by a single printhead of the same size or having the same number of jets as either of the first and the second printheads 232, 242, or by two such printheads aligned in a parallel and jet to jet manner, or with no offset.

The two replaceable printhead cartridges 210, 212 are individually clamped to the moveable common printhead carriage 214 so as to maintain their relative locations and offset. The moveable common printhead carriage 214 may then be mounted on rails and driven by a stepper motor and toothed belt assembly (not shown), to each printing position (front 230 and rear 240), and to the maintenance position 250. In operation, the two replaceable printhead cartridges 210, 212 are stationary during printing, and during maintenance. Media (envelopes) motion at the first printing positions 230 is supplied by an assembly 234 of the machine 8. A home position sensor (not shown) may be used for example to indicate when the moveable common printhead carriage 214 is in the maintenance position 250 and thus ready for maintenance carriage 245 motion and positioning.

At the maintenance position 250, the dual maintenance units 252, 254 are mounted on the common maintenance carriage 245, and are offset one from the other in order to enable them to mate effectively with the offset printheads 232, 242 of the replaceable printhead cartridges 210, 212. The maintenance units 252, 254 are thus suitable for providing purging, wiping, capping and priming functions simultaneously to both printheads of the printhead cartridges. Dual vacuum pumps (not shown) that are driven by a common motor (not shown) can provide the priming pressure to the maintenance units.

The maintenance carriage 245 can be mounted on rails and also driven by the stepper motor and toothed belt assembly (none shown) in a direction orthogonal to that of the moveable common printhead carriage 214. A home position sensor also may indicate when the maintenance carriage 245 is in the parked position so as to permit safe and non-interfering motion of the common printhead carriage 214. Additional sensors may also be employed to indicate printing positions of the common printhead carriage 214, and the capping position of the maintenance carriage 245.

Also included in the wide swath envelope printing module 200 (FIG. 3) are motor controller electronics 264 along with secure print head driver electronics 262 which interface with the mailing machine controller 100. The secure driver electronics 262 are mounted on the moveable common, printhead carriage 214 and are designed to be tamper proof. Encoded print data, sent from the mailing machine controller 100, is decoded by the secure electronics and sent to the printheads 232, 242 for controlling ink drop ejection.

Alignment images may be provided to allow the machine operator to optimize the alignment of printing between the two printhead cartridges along the jet axes, and in the envelope motion direction, by inputting the results of the printed images into the mailing machine controller 100.

Referring again to FIGS. 1 and 2, printed envelopes are output from the wide swath envelope printing module 200 and forwarded to a drying buffer station 68 which extends the transport time of a succession of in order to allow time for the printed addresses thereon to dry.

After the printed address has dried on each envelope on the buffer 68, such envelope proceeds to a flap opener station 72 where the envelope flap is opened prior to insertion of documents and possibly other items.

Meantime, while the such an envelope is drying on drying buffer 68, printer controller 58 outputs a page of document data to document printer engine 60 which prints such data on a page in a conventional manner. After such page is printed, it is received by an accelerator station 76, and is accelerated to a faster speed at which mail finishing unit 64 operates.

Accelerator station 76 then transfers the printed page to accumulator station 78 and, if a plurality of pages are to be included in the mail piece, the above described operations are repeated until all the document pages are in accumulator station 78. If the mail piece attributes specified for the mail piece include a preprinted insert, such a preprinted insert may be fed from insert feeder 96 to accumulator station 78.

Once completed the accumulation of printed document pages and any preprinted inserts are transferred from accumulator station 78 to folder station 80 where the accumulation is folded into either a "C" or "Z" fold as specified in the mail piece attribute data. Once the folded accumulation is present at folder station 80 the envelope, with its flap open, is fed (or has been fed) to inserter station 82 and the folded accumulation is transferred from folder station 80 to inserter station 82 for insertion into the envelope.

The mail piece (i.e., the envelope with all printed documents inserted) is fed from inserter station 82 to moistener station 84 where the envelope flap is moistened if the mail piece is to be sealed. The mail piece then proceeds to flap closer station 86, sealer 90 and output stacker 94 where the completed mail piece, including all inserts, with an address and possible return address printed on a conventional envelope, and which has been sealed if so specified, is output for delivery to the postal service.

As can be seen, there has been provided an apparatus for producing pieces of mail, that includes mail handling assemblies and a printing module. The printing module is connected to the mail handling assemblies and having a first printing position, a second printing position, a moveable carriage for moving to and from the first printing position and the second printing position, and a first printhead cartridge mounted at a first location on the moveable carriage and including a first printhead having a first path of movement with the moveable carriage at and through the first printing position and the second printing position. The printing module also includes a second printhead cartridge mounted at a second location on the moveable carriage for increasing a width of a swath printed by the first printhead cartridge and the second printhead cartridge. The second printhead cartridge includes a second printhead having a second path of movement with the moveable carriage at and through the first printing position and the second printing position. The apparatus for producing mail pieces further includes a first registration member located at the first printing position for maintaining a first gap between pieces of mail to be printed on by the first printhead and the second printhead, and a second registration member located at the second printing position for maintaining a second gap between itself and the first printhead and the second printhead.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. An apparatus for producing pieces of mail, the apparatus comprising:

a. mail handling assemblies;

b. an envelope printing module connected to said mail handling assemblies, said envelope printing module having:

(i) a plurality of printing positions including a first printing position and a second printing position on the same envelope;

(ii) a moveable printhead carriage for moving to and from said first printing position and said second printing position;

(iii) a first printhead cartridge mounted at a first location to said moveable printhead carriage and including a first printhead having a first path of movement with said moveable printhead carriage at and through said first printing position and said second printing position; and (iv) a second printhead cartridge mounted at a second location to said moveable printhead carriage for increasing a width of a swath printed by said first printhead cartridge and said second printhead cartridge, said second printhead cartridge including a second printhead having a second path of movement with said moveable printhead carriage at and through said second printing position, and said first printhead cartridge and said second printhead cartridge being mounted such that said first printhead and said second printhead have offset and parallel jet axes.

2. The apparatus of claim 1, including a maintenance position spaced from said first printing position and said second printing position.

3. The apparatus of claim 1, wherein said first printhead and said second printhead are each thermal ink jet printhead.

4. The apparatus of claim 1, wherein said moveable printhead carriage is stationary during a printing operation and mail envelopes to be printed are moved past said first printhead cartridge and said second printhead cartridge.

5. The apparatus of claim 2, wherein said moveable printhead carriage is also moveable to and from said maintenance position.

6. The apparatus of claim 2, including a first maintenance unit and a second maintenance unit for cleaning said first and said second printheads at said maintenance position.

7. The apparatus of claim 1, wherein said offset and parallel jet axes overlap by a number of jets along a direction of said parallel jet axes.

8. The apparatus of claim 6, wherein said first maintenance unit and said second maintenance unit, are offset relative to one another for properly aligning with said first and said second printheads.

9. The apparatus of claim 7, wherein said offset and parallel jet axes overlap by about 4 jets.

* * * * *